US005806809A

United States Patent [19]

Danner

[11] Patent Number: 5,806,809

[45] Date of Patent: Sep. 15, 1998

[54] RAILROAD SWITCH POINT POSITION SENSING SYSTEM AND METHOD

[76] Inventor: Don D. Danner, N. 21326 Panorama Rd., Colbert, Wash. 99005

[21] Appl. No.: 816,167

[22] Filed: Mar. 12, 1997

[51] Int. Cl.[6] ..... B61L 5/00

[52] U.S. Cl. ..... 246/220; 246/253; 246/476

[58] Field of Search ..... 246/162, 176, 246/220, 221, 222, 223, 253, 476

[56] References Cited

U.S. PATENT DOCUMENTS

| | | | |
|---|---|---|---|
| 975,922 | 11/1910 | Adams | 246/220 |
| 2,651,714 | 9/1953 | Poole | 246/162 |
| 4,986,498 | 1/1991 | Rotter et al. | 246/220 |
| 5,192,038 | 3/1993 | Ocampo | 246/220 |
| 5,253,830 | 10/1993 | Nayer et al. . | |
| 5,374,016 | 12/1994 | Durchschlag . | |
| 5,494,242 | 2/1996 | Ludwick et al. . | |
| 5,504,405 | 4/1996 | Hager . | |
| 5,529,267 | 6/1996 | Giras et al. . | |
| 5,547,151 | 8/1996 | Giras et al. . | |
| 5,582,370 | 12/1996 | Myers et al. . | |

FOREIGN PATENT DOCUMENTS

| | | | |
|---|---|---|---|
| 294219 | 9/1991 | Germany | 246/220 |
| 3-295902 | 12/1991 | Japan | 246/220 |

OTHER PUBLICATIONS

General Railway Signal's Installation, Operation and Maintenance Pamphlet 1293, published Feb., 1987, for Electric Switch Machines.

*Primary Examiner*—Mark Tuan Le
*Attorney, Agent, or Firm*—Litman, McMahon & Brown

[57] ABSTRACT

A switch point position detecting system and method uses a plurality of proximity detectors positioned proximate the switch point or points of a railroad switch. Additional proximity detectors are placed within a switch machine housing to detect the position of components therein, such as lock rods and lock bars. One or more Programmable Logic Controllers (PLC's) have inputs connected to the proximity detectors and outputs connected to relays or switches which control the switch machine and signals. The PLC's are programmed to operate the relays to give signals to proceed only when correct indications are received from all effected proximity detectors.

33 Claims, 9 Drawing Sheets

RAILROAD SWITCH POINT POSITION SENSING SYSTEM AND METHOD

BACKGROUND OF THE INVENTION

1. Field of the Invention

The present invention relates generally to a system and method for reliably and positively sensing the position of a pair of railroad switch points driven by a manual or electrical switch machine. More particularly, the system and method employs at least one proximity sensor positioned to move with the switch points and to forward a signal to a logic circuit when the switch point is proximate one of the stock rails of the track.

2. Description of the Related Art

In order to optionally switch a railroad train operating on a first track to a second, merging track, it is typical to provide a switch with a pair of "switch points" which are selectively movable horizontally to deflect the train toward one or the other of the tracks. The switch can encompass a pair of switch rail lengths of the second track which extend several feet in length with the switch points being essentially tapered end sections of these switch rail lengths.

The switch points, typically labeled as "normal" and "reverse", are selectively movable back and forth between a pair of stock rails between a normal position in which the train is directed toward the first track by the normal switch point being positioned against a first rail of the first track and a reverse position in which the train is directed toward the second track by the reverse switch point being positioned against the opposite rail of the first track.

The switch points are typically attached to each other via a plurality of tie rods, at least one of which doubles as a switch throw rod. The throw rod is driven by a remotely controlled electrical switch machine, or, in some instances, by a hand lever operated switch machine, between extended and retracted positions. Depending upon the side of the track on which the switch machine is placed, the extended position can be the normal or the reverse condition of the switch points, and vice versa for the retracted position.

It is essential with the complexity of modern railroad operations that the position of the switch points be positively and reliably sensed and forwarded. Without this information, reliable train signalling cannot be accomplished and derailings or even train collisions are possible.

In the United States, most remotely controlled electric railroad switch machines are made by two companies, i.e. General Railway Signal Corp. of Rochester, N.Y. and Union Switch and Signal, Inc. of Pittsburgh, Pa. The machines made by these companies differ in many details, but their overall functions are very similar. Machines of both manufacturers use reversible electric motors to drive a series of gears which are attached to the throw rod. Depending upon the control signals received at the switch machine, the motor is driven one direction or the other to either extend or retract the throw rod and thus move the switch points between normal and reverse switching positions.

A lock connecting rod is also attached to the switch points in machines of both manufacturers and the lock connecting rods passively move back and forth with the switch points and cooperate with locking elements in the machine housing to lock the switch into a normal or a reverse switch position.

Furthermore, in machines of both manufacturers, a point detector connecting rod is attached proximate the near switch point with the point detector rod including notches which cooperate with cams or yokes in the switch machine to selectively actuate a number of contacts to indicate switch position. The status of these contacts can be remotely sensed by control and signalling circuitry to give an indication of switch point position. This gives railroad engineers and monitors a degree of certainty that the switch points are in the correct position and the switch machines are in the correct orientation for the desired train operation.

A number of problems are presented with the known apparatus and methods of sensing switch point position. One problem is the use of movable mechanical yokes driven by the point detector connecting rod to actuate stationary spring contacts within the switch machine housing. As with all electrical contacts, these are subject to wear and pitting, which can ultimately lead to undesired short or open circuits. A false or contradictory reading or switch point position indication can result. A second problem is the use of a physical point detector connecting rod attached to the near switch point. This rod is subject to abuse and wear which can ultimately result in its bending or breaking. Again, with a bent or broken point detector connecting rod, false or contradictory switch point position indication can result.

Finally, the point detector rod is connected to the switch 1 by a point detector connecting rod which is typically attached only to the near switch point, traveling back and forth with that switch point. Thus, the point detector connecting rod only gives an indication of the position of the near switch point. If problems occur in the switching points themselves, such as, e.g., broken tie rods or a "laying over" of the far switch point, the point detector rod can still give a safe indication. It is known for train derailings to occur in such situations even though the switch machine point detector contacts were giving safe normal or reverse indications.

One attempt to address the sensing of switch point condition is that described in U.S. Pat. No. 5,253,830 to Nayer et al. and entitled METHOD FOR MONITORING THE CONDITION OF RAIL SWITCH POINTS. This patent describes the positioning of a single stationary proximity sensor in the region of a switch point. The sensor is described as inductive or capacitive, thus giving a reading which is proportional to the distance between the switch point and the stock rail. These distance readings are stored and monitored during passage of a train, and an alarm is generated if the distance becomes less than a critical distance, thus indicating a switch point worn beyond safety tolerances. The proximity sensor in the Nayer et al. patent is not used for detecting switch point position per se.

It is clear, then, that an improved, more reliable railroad switch point position detecting system and method is needed for the railroad industry. Such a system and method should eliminate or minimize the problems of prior art point position detectors, including those enumerated above. Finally, such an improved switch point position detecting system and method should be readily adaptable to existing switch machines and switch machine designs.

SUMMARY OF THE INVENTION

The present invention comprises the use of one or more proximity detectors positioned proximate the switch point or points of a railroad switch. Additional proximity detectors are placed within the switch machine housing to detect the position of components therein, such as locking rods and locking bars. One or more Programmable Logic Controllers (PLC's) have inputs connected to the proximity detectors and outputs connected to relays or switches which control the switching machine and signals. The PLC's are programmed to operate the relays to give signals to proceed only when correct indications are received from all effected proximity detectors.

OBJECTS AND ADVANTAGES OF THE INVENTION

The principle objects and advantages of the present invention include: providing an improved railroad switch point position sensing system and method; providing such a system and method in which a plurality of proximity detectors are positioned proximate the switch points and within a switch machine housing; providing such a system and method in which one or more PLC controllers are connected to receive signals from the proximity detectors; providing such a system and method in which the PLC(s) are attached to control signalling relays or switches with the PLC(s) being programmed to provide safe signals only when all effected proximity detectors give the correct signal; providing such a system and method in which existing switch machines can be easily and economically retrofitted to incorporate improved switch point position sensing capabilities; and providing such a system and method which is reliable, relatively economical, and which is particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
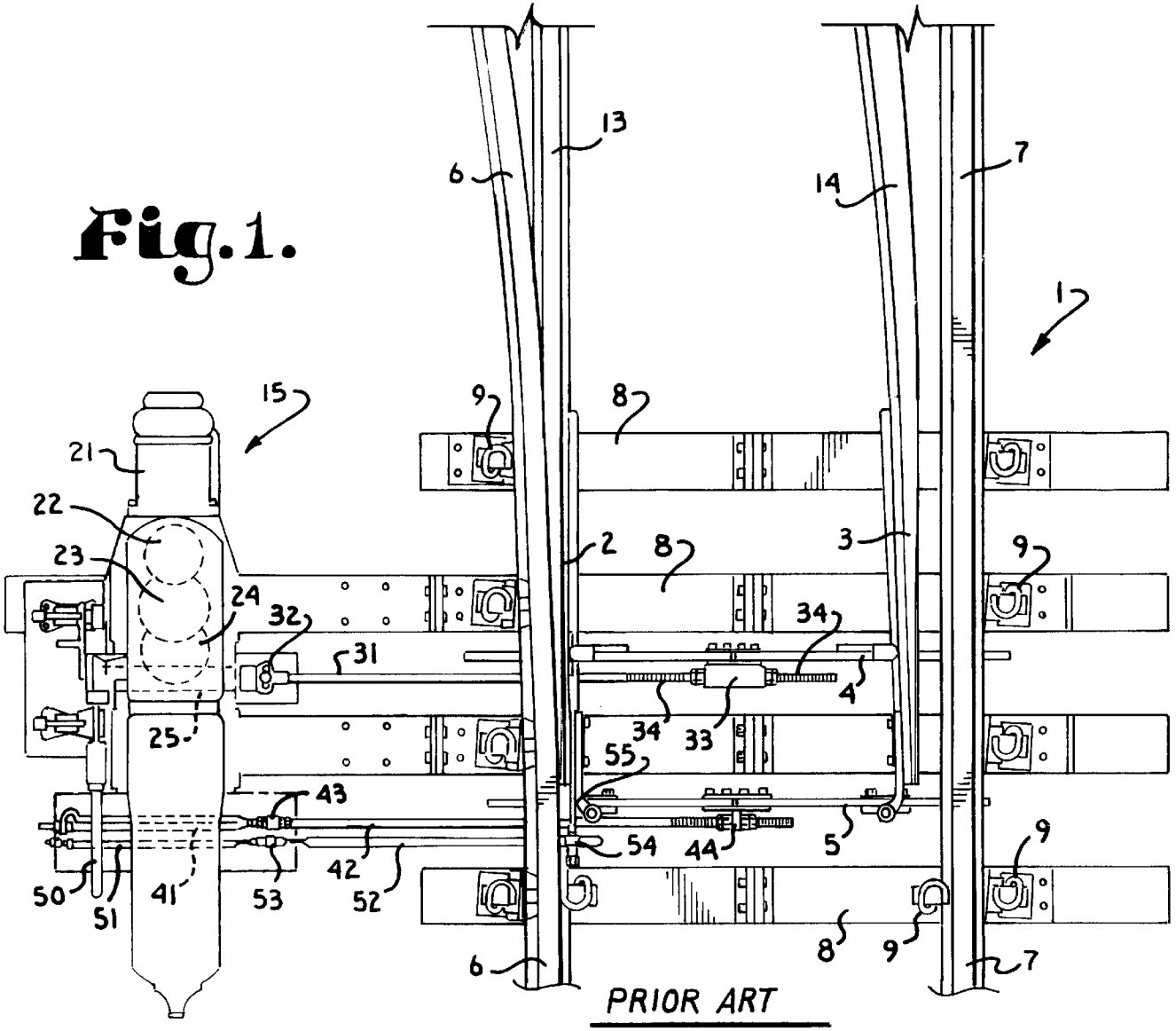
FIG. 1 is a top plan view of a General Railway Signal switch machine with the outline of switch operating gears shown in phantom lines and equipped with a prior art switch point position sensor, with the switch points switched to a "normal" position in which a train would continue straight through the intersection.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "up", "down", "right" and "left" will refer to directions in the drawings to which reference is made. Said terminology will include the words specifically mentioned, derivatives thereof and words of a similar import.

Referring to the drawings in more detail, reference numeral 1 in FIG. 1 generally designates a railroad switch is generally indicated at 1. The switch 1 includes a pair of switch points 2 and 3 which are linked by a pair of tie rods 4 and 5. The switch points 2 and 3 are selectively movable between a "normal" position (as shown) and a "reverse" switch point. In the illustrated normal position, the switch point 2, commonly called the normal switch point, is positioned against a stationary stock left rail 6 and the switch point 3, commonly called a reverse switch point, is moved away from a stationary stock right rail 7. The stock left and right rails 6 and 7 are anchored to a plurality of cross ties 8 via rail anchors 9 in a conventional manner. In a normal position, the normal switch point 2 will direct a train entering the switch 1 straight through the intersection via the right stock rail 7 and the switch point 2, which tapers outward into a straight left rail 13 past the switch 1.

In a reverse position (not shown) both the normal switch point 2 and the reverse switch point 3 are moved to the right with the normal switch point 2 thus moving away from the stock left rail 6 and the reverse switch point 3 moving to a position against the stock right rail 7. The reverse switch point 3 is thus in a position to direct the train to the left via the left rail 6, which curves to the left past the switch 1, and via the reverse switch point 3, which tapers outward to a curved right track 14 past the switch 1.

The switch points 2 and 3 are selectively moved via a switch machine 15. The illustrated switch machine 15 is similar to switch machine models 5E, 5F, 5G, and 5H manufactured by the General Railway Signal Corporation, but it should be emphasized that the invention is in no way limited to these machines. The switch machine 15 includes a reversible electric motor 16 (FIG. 11*c*) in a motor housing 21 which motor 16 is connected to drive a series of gears 22–24, shown in phantom lines in FIG. 1, which gears 22–24, in turn, drive a throw bar 25, also shown in phantom lines in FIG. 1, either to the left or the right. The throw bar 25 is connected to a throw rod 31 via a linkage 32 and the throw rod 31 is connected to the tie rod 4 via a switch basket 33. The switch basket 33 is internally threaded to receive threads 34 on the throw rod 31 so that the switch point position at either end of the travel of the throw rod 31 is adjustable. A typical stroke length for the throw bar 25 would be approximately five inches.

Figure 2:
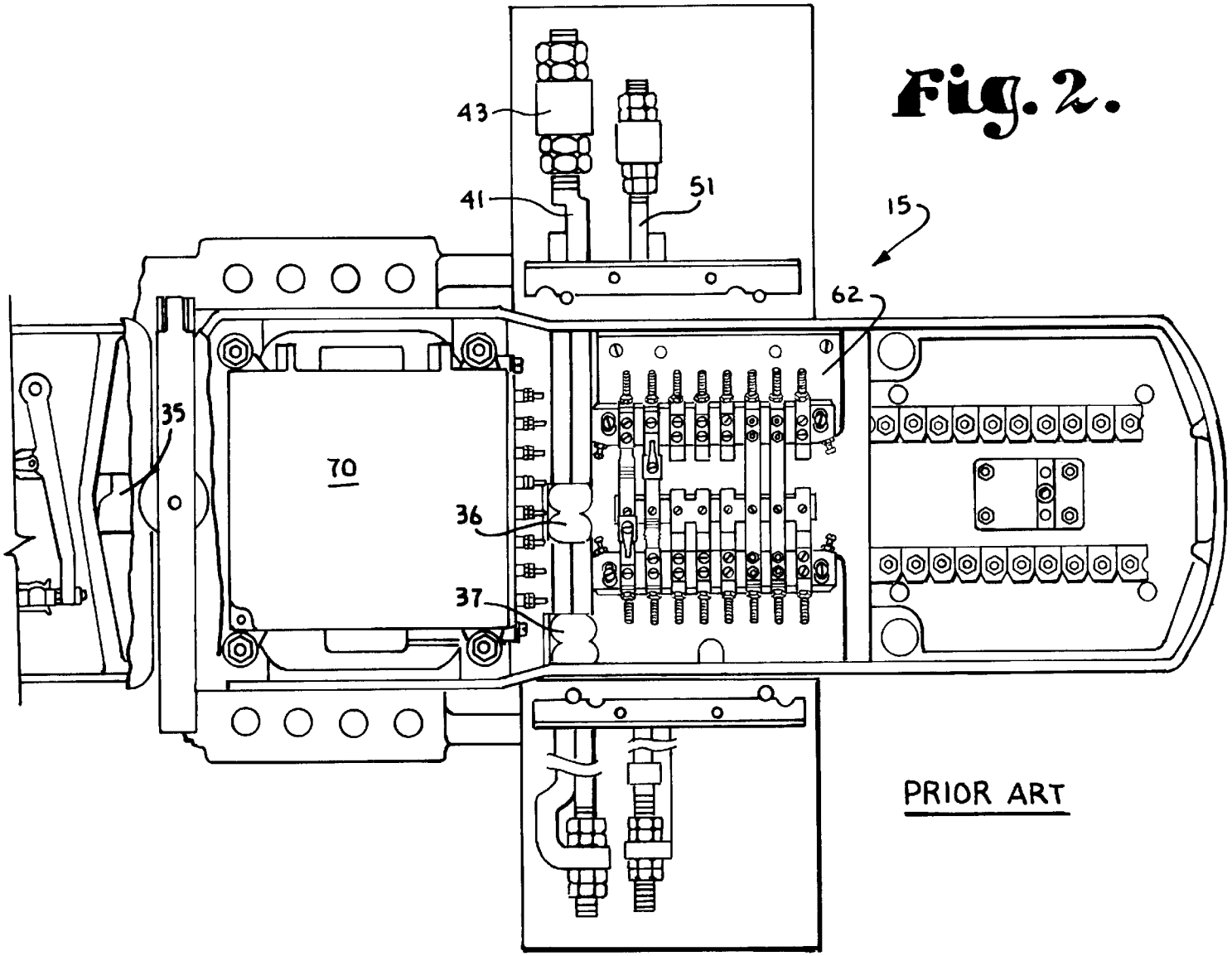
FIG. 2 is an enlarged, fragmentary, top plan view of the switch machine of FIG. 1, with the cover removed to reveal a motor and gear drive section, a biased neutral controller section, a conventional point detector movement and contacts section with a point detector rod extending therethrough and a terminal board section.

Referring to FIG. 2, along with FIG. 1, pertinent portions of the switch machine 15 are illustrated in greater detail. In addition to moving the throw bar 25 to the left and right, the motor 16 and connected gears 22–24 also move a lock bar 35, only a portion of which is shown in FIG. 2, left and right in FIG. 2 (which is equivalent to up and down in FIG. 1). The lock bar 35 cooperates with notches and flanges 36 and 37 on a lock rod 41 within the switch machine 15 to lock the switch points 2 and 3 in either the normal or the reverse position.

The lock rod 41 is connected to a first end of a lock connecting rod 42 via a threaded link 43, and the opposite end of the lock connecting rod 42 is attached to the tie rod 5 via a universal threaded connector 44. The lock rod 41 is passive in operation, i.e. it is driven left and right (in FIG. 1) solely by the movement of the switch points 2 and 3 as translated by the connection of the lock rod 41 to the tie rod 5 via the lock connecting rod 42. The lock rod 41, in cooperation with the lock bar 35, locks the switch 1 to prevent unwanted movement of the switch points 2 and 3 when they are in either the normal or reverse position. The switch 15 can be operated by hand via a hand lever 50 under emergency conditions.

II. Prior Art Switch Point Position Detection

Figure 3:
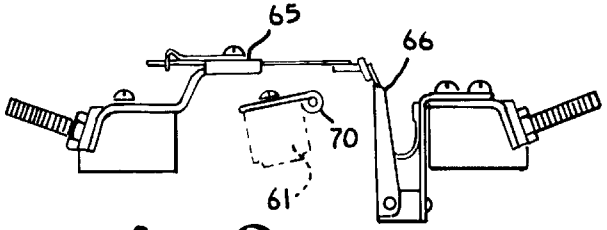
FIG. 3 is a greatly enlarged side elevational view of a pair of shunt and motor control contacts in the switch machine of FIG. 2.
Figure 4:
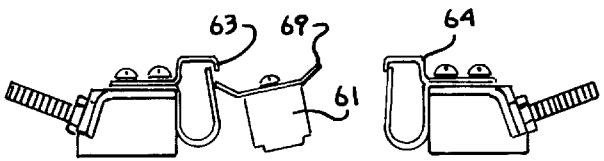
FIG. 4 is a greatly enlarged side elevational view of a pair of normal and reverse switch point position indicating contacts in the switch machine of FIG. 2.
Figure 5:
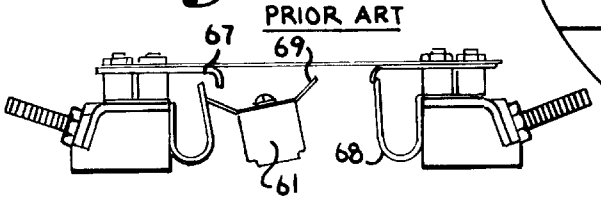
FIG. 5 is a greatly enlarged side elevational view of a pair of shunt contacts in the switch machine of FIG. 2.

The switch machine 15 also includes a point detector rod 51 which is attached to a first end of a point detector connecting rod 52 via a threaded connector 53. An opposite end of the point detector connecting rod 52 is attached, via a pivoting connector 54, to an extension 55 of the normal switch point 2. As the normal switch point 2 is moved back and forth between the normal and reverse switch positions, the point detector rod 51, via its connection to the point detector connecting rod 52, is moved back and forth within the switch machine 15. The point detector rod 51, as it moves back and forth, encounters a series of rollers (not shown) which move a yoke 61 (FIGS. 3–5) back and forth beneath a point detector contact board, generally indicated at 62 in FIG. 2. Among the contacts in the board 62 are normal and reverse contacts 63 and 64 (FIG. 4), shunt and motor control contacts 65 and 66 (FIG. 3), and shunt contacts 67 and 68 (FIG. 5). As the yoke 61 is moved back and forth by the operation of the point detector rod 51, the normal and reverse contacts 63 and 64, the shunt and motor control contacts 65 and 66, and the shunt contacts 67 and 68, respectively, are alternately opened or closed by action of spring contactors 69 or roller 70 carried by the yoke 61. The normal and reverse contacts 63 and 64 control current to a pair of external relays (not shown) which, in turn, control external signals and lock-outs which assure train safety. The shunt and motor contacts 65 and 66 control a biased neutral controller 70, which supplies current to the motor 16. The shunt contacts 67 and 68 supply power to the rest of the switch machine 15. More detailed specifics of the operation of the contact block 62 and the point detection rod 51 are provided in Pamphlet 1293, revised February, 1987 by General Railway Signal Corporation and entitled MODELS 5E, F, G, and H ELECTRIC SWITCH MACHINES, which is hereby incorporated by reference. As described earlier, however, the use of mechanical spring contacts 63–67, driven mechanically via the point detector rod 51, present a number of maintenance and reliability problems which the present invention is designed to remedy.

III. Inventive Switch Point Position Detection

Figure 7:
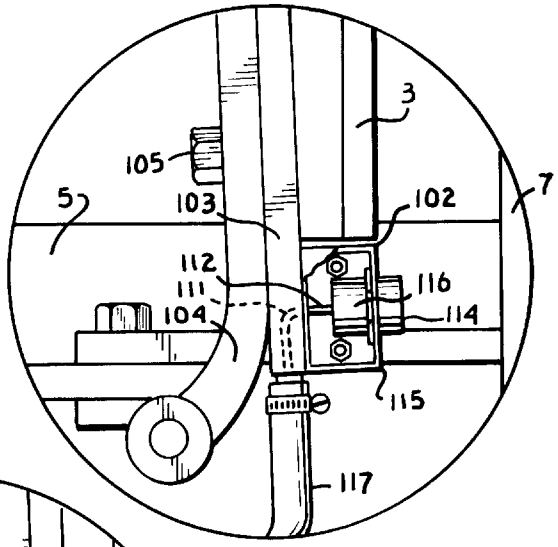
FIG. 7 is a greatly enlarged, fragmentary top plan view of the portion of FIG. 6 designated with a circle and labeled "7", showing the switch point remote from the switch machine in a normal position with a proximity sensor positioned away from the stock rail so as to give no proximity signal.
Figure 8:
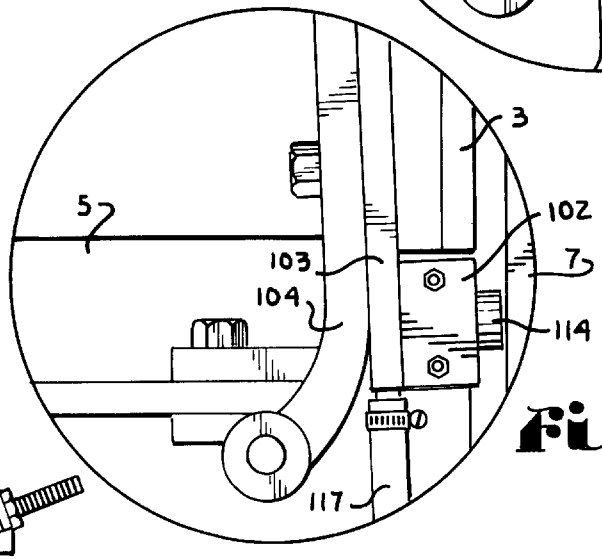
FIG. 8 is a greatly enlarged, fragmentary top plan view of the portion of FIG. 6 designated with a circle and labeled "7", showing the switch point remote from the switch machine in a reverse position with a proximity sensor positioned near the stock rail so as to give a proximity signal.
Figure 6:
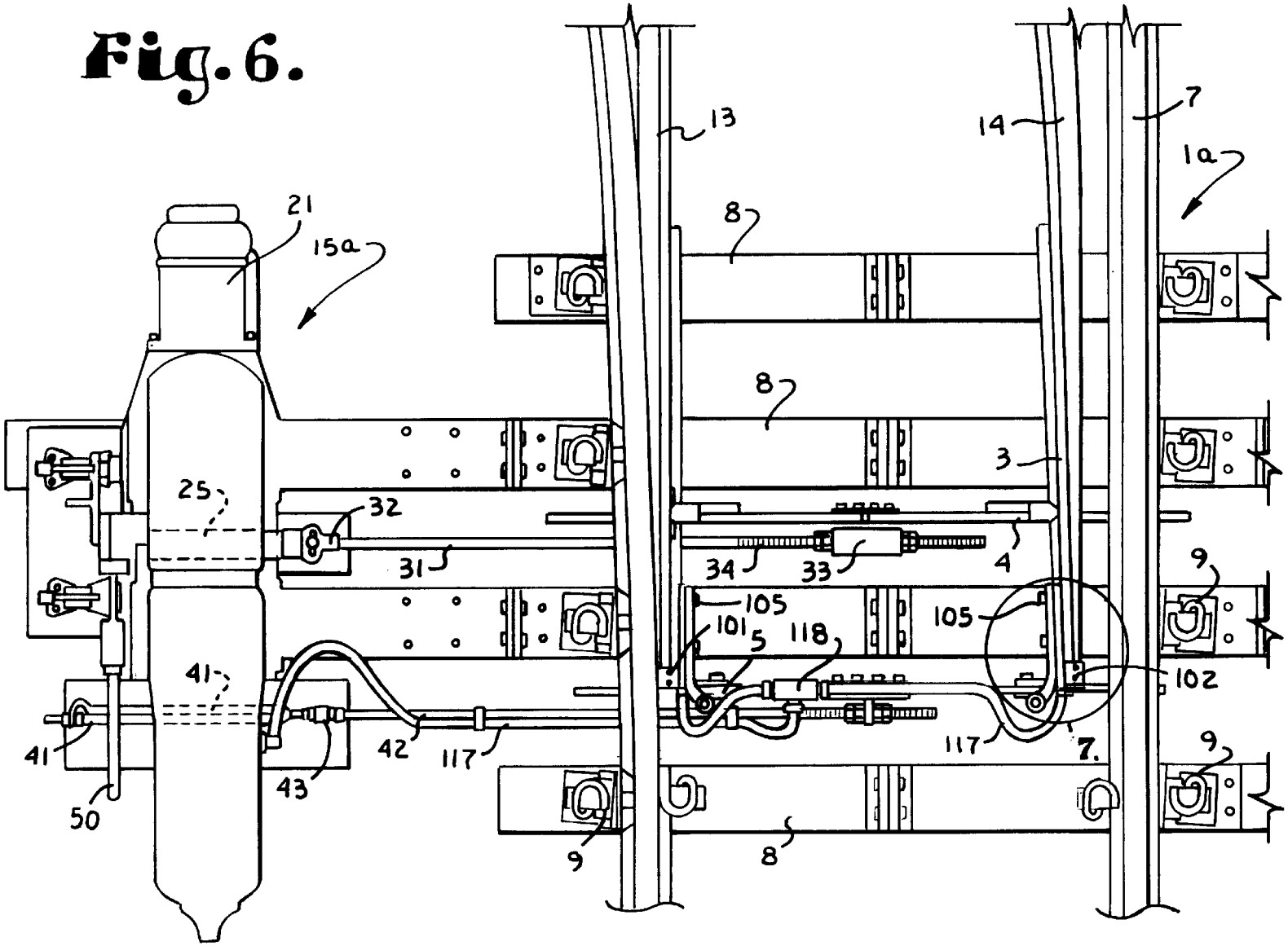
FIG. 6 is a top plan view of a General Railway Signal switch machine similar to that of FIGS. 1–5, but modified to incorporate the inventive switch point position sensor, again with the switch points switched to a "normal", position in which a train would continue straight through the intersection.

The inventive point detection system and method is shown and described in FIGS. 6–10 and 11*a*–11*c*. FIG. 6 illustrates a railroad switch la with a switch machine 15*a*, both modified in accordance with the present invention. Elements of the switch 1*a* and the switch machine 15*a* which are the same as in FIG. 1 are numbered consistently in both Figures. Referring to FIGS. 6–9, the switch 1*a* has been modified by positioning a normal proximity sensor 101 on the normal switch point 2 and a reverse proximity detector 102 on the reverse switch point 3. The reverse proximity detector 102 is shown in greater detail in FIGS. 7 and 8. A plate 103 is sandwiched between a front end lug 104 and the reverse switch point 3 and is held there by through bolts 105. The plate 103 extends forward past the reverse switch point 3 a distance sufficient to allow the reverse proximity detector 102 to be attached thereto on the side nearest the stock rail 7. The plate 103 includes a channel 111 shown in phantom lines which accommodates a wire pair 112 leading to the reverse proximity detector 102 from a conduit 113. The proximity detectors 101 and 102 are identical, and include an exterior sensor 114 which extends outward from a housing 115 with an internal switch 116 positioned within the housing 115. The proximity detectors 101 and 102 are designed to close a circuit in the internal switch 116 when the exterior detector 114 is placed near any metallic object. The metallic object, in this case the stock rails 6 or 7, excites a field in the detector 114 when it is brought within a predetermined distance, e.g. within ¼inch, as shown in FIG. 8, which field is detected by the switch 116, which then closes. Once the sensor 114 is moved out of proximity of the rails 6 or 7, as shown in FIG. 7, the switches 114 in each of the proximity detectors 101 and 102, then open the circuit. Thus, a closed circuit indication is given by the normal proximity sensor 101 when the switch 1 is in the normal position, and a closed circuit indication is given by the reverse proximity detector 102 when the switch 1 is in the reverse position. A combined conduit 117, attached to the tie rod 5 via a T connector 118, protects the wire pairs 112 from the proximity detectors 11 and 102 as they lead from the switch 1*a* into the switch machine 15*a*.

Figure 9:
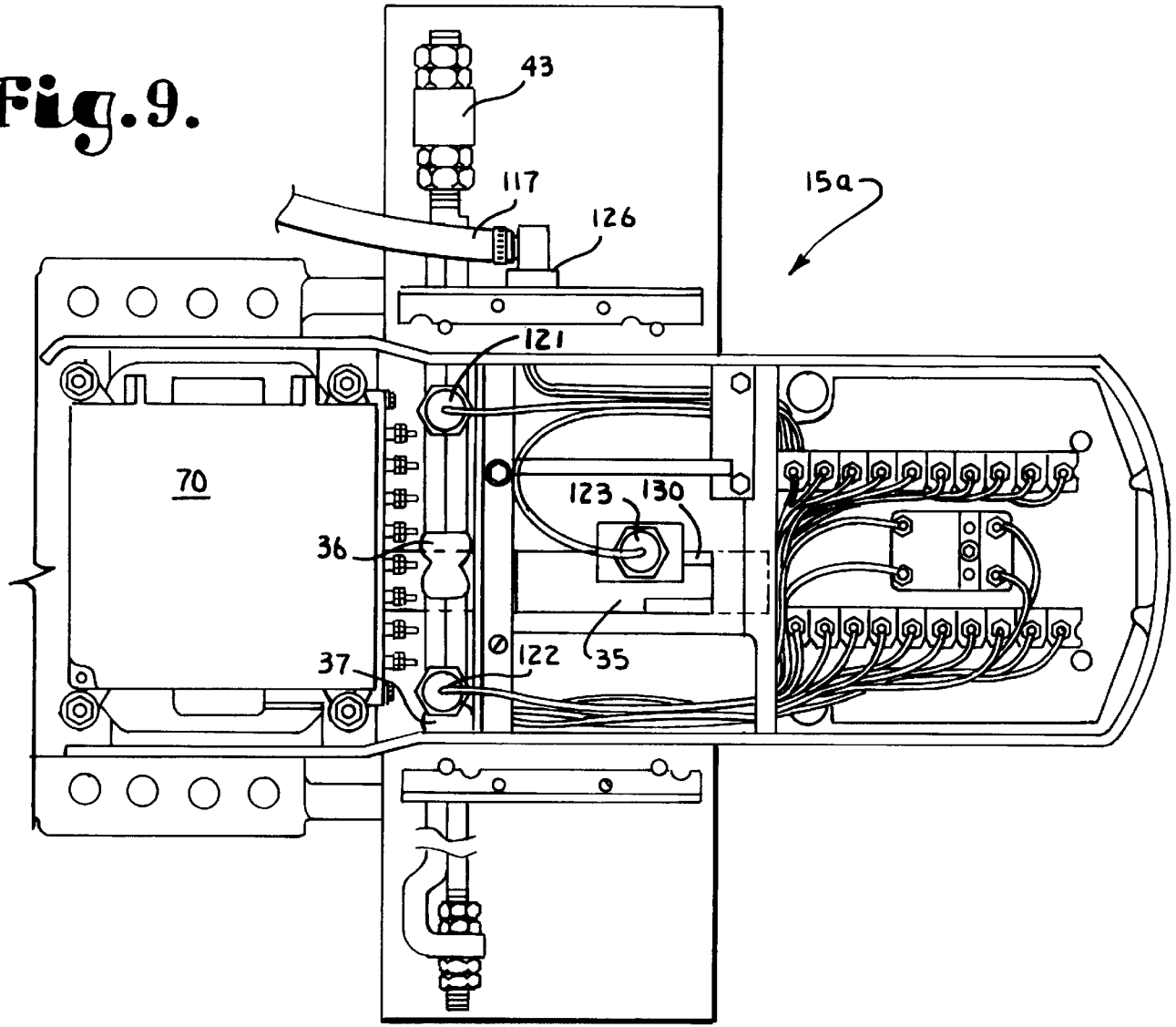
FIG. 9 is an enlarged, fragmentary, top plan view of the switch machine of FIG. 6, with the cover removed to reveal a biased neutral controller section, an inventive point detector section with point detector contact block and point detector rod removed, and a terminal board section.
Figure 10:
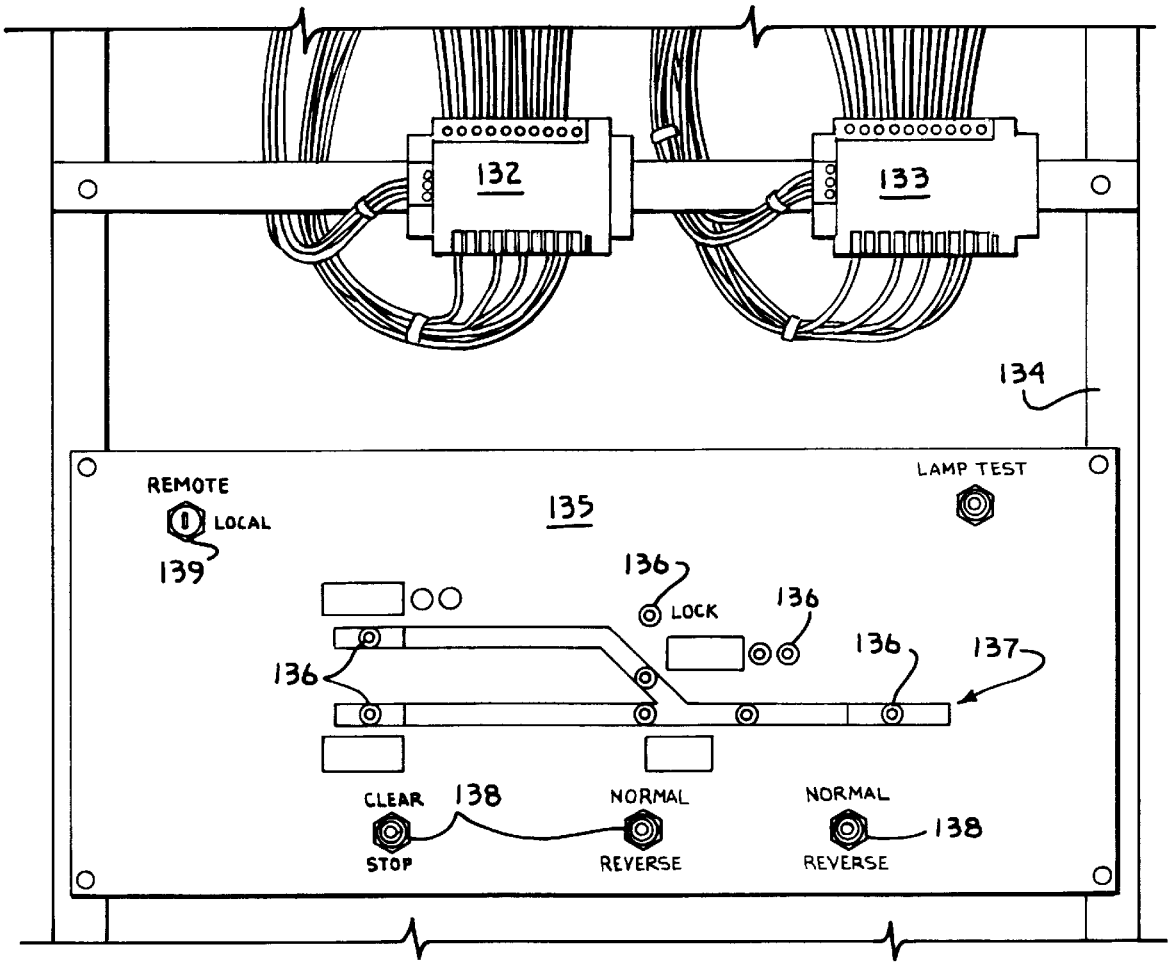
FIG. 10 is a fragmentary front elevational view of a programmed control section of the inventive switch point position detection system showing an equipment rack with a pair of connected PLC's positioned above a railroad switch signal board.

Referring to FIG. 9, the switch machine 15*a* is shown with the cover removed and with the inventive switch point position sensing system installed. In comparing FIG. 9 with FIG. 2, it is clear that the point detector rod 51 has been removed, as has the contact board 62. In their place, three proximity detectors 121, 122 and 123 have been positioned within the switch machine 15*a*. The proximity detectors 121 and 122 are normal and reverse lock rod position detectors. The lock rod 41 includes the pair of flanges 36 and 37 which cooperate with the lock rod 35. When the switch 1*a* is in the normal position, the lock rod 41 is moved all the way into the switch machine 15*a*, i.e. toward the bottom of FIG. 9, to the position shown in FIG. 9. The lock bar 35 is moved to the left through the flange 36 to lock the switch machine 15*a* and the switch 1*a* into the normal position. When the lock rod is in the normal position, the flange 37 is positioned proximate the proximity detector 122, which then closes a switch, as described above with respect to the detectors 101 and 102. By contrast, when the switch 1*a* is changed to the reverse position, the lock bar 35 is moved to the right to release the lock rod 41, which is then moved all the way toward the track, i.e. toward the top of FIG. 9. The lock bar 35 is moved back to the left through the flange 37 to lock the switch machine 15*a* and the switch 1*a* into the reverse position. When the lock rod is in the reverse position, the flange 36 is positioned proximate the proximity detector 121, which then closes a switch, as described above with respect to the detectors 101 and 102.

The proximity detector 123 is a lock bar detector which detects the locked condition of the switch machine 1*a*. The lock bar 35 has a Y shaped protrusion 131 positioned atop the end portion thereof which was originally intended to cooperate with the removed contact block 62. When the lock bar 35 is in the locked position, i.e. in the solid line position of FIG. 9, the Y protrusion 130 is moved beneath the proximity detector 123, which then closes a internal switch as described above. When the lock bar 35 is moved to the right, out of engagement with the lock rod 41, then the proximity detector 123 gives an open circuit (unlocked) indication. The proximity detectors 101, 102, and 121–123 can be model XS1 M30DA210L1TF manufactured by Telemecanique of France. These detectors have a wide temperature operating range and are reliable at temperatures down to 40 degrees Fahrenheit below zero and have a 12–48 volt operating range. The removal of the point detector rod 51 provides a convenient inlet 126 for the conduit 117 into the switch machine 15*a*.

FIGS. 10 and 11*a*–11*c* illustrate a pair of programmable logic controllers (PLC's) 132 and 133, which are positioned on a terminal rack 134 in a location remote from the switch machine 15*a*. A local controller and switch indication board 135 is shown attached to the rack 134 as well. The board 135 includes a number of indicator lamps 136 which mirror the condition of track side signals (not shown) positioned in similar positions on the track as shown in the switch representation 137. Local switch selector toggle switches 138 are provided for local switch control when a remote/local key switch 139 is switched to local.

The particular PLC's 132 and 133 illustrated and described herein are IDEC Micro-1 PLC's, which are virtually identical to Square D Micro-1 PLC's and can be used interchangeably. Each PLC 132 and 133 has a common reference COM and 8 inputs, numbered 0–7 in FIG. 11*a*, which inputs are wired in common. Each of the proximity detectors 101, 102, and 121–123 is connected to a respective one of the numbered inputs 0–7 to selectively link the input to a common bus 141. Additional inputs of the PLC's 132 and 133 are connected to external contacts of three different relays. The contact OSTPPR is a contact of an on switch track repeater relay OSTPP (not shown). The contact NWZ is a contact of a normal switch request relay (not shown), and the contact RWZ is a contact of reverse switch request relay (not shown). The normal switch request relay is energized when a normal switch position is remotely selected and the reverse switch request relay is energized when a reverse switch position is remotely selected.

Figure 11A:
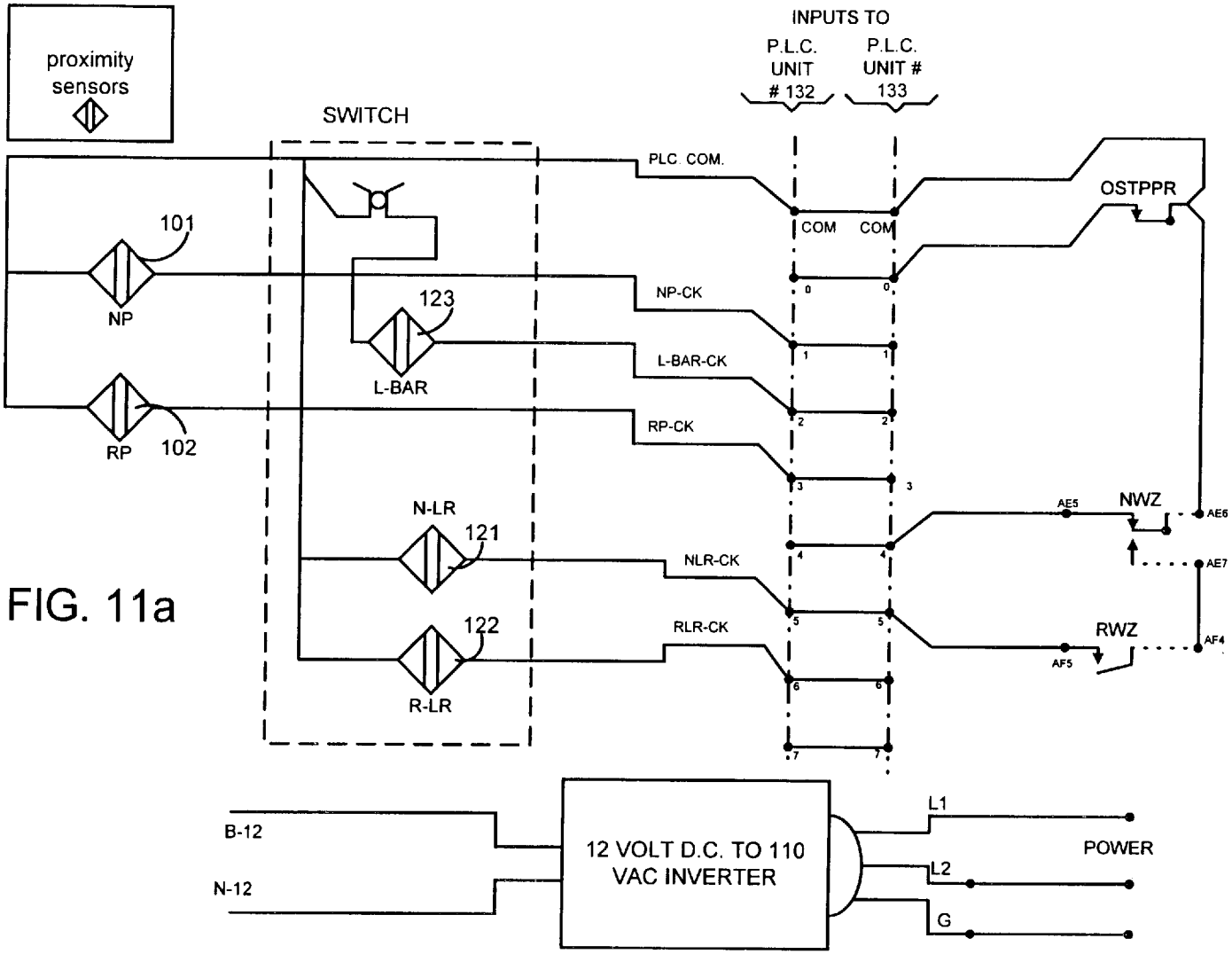
FIG. 11*a* is an electrical schematic of the PLC inputs from proximity detectors of the inventive switch point position detection system and relay contacts from external relays.
Figure 11B:
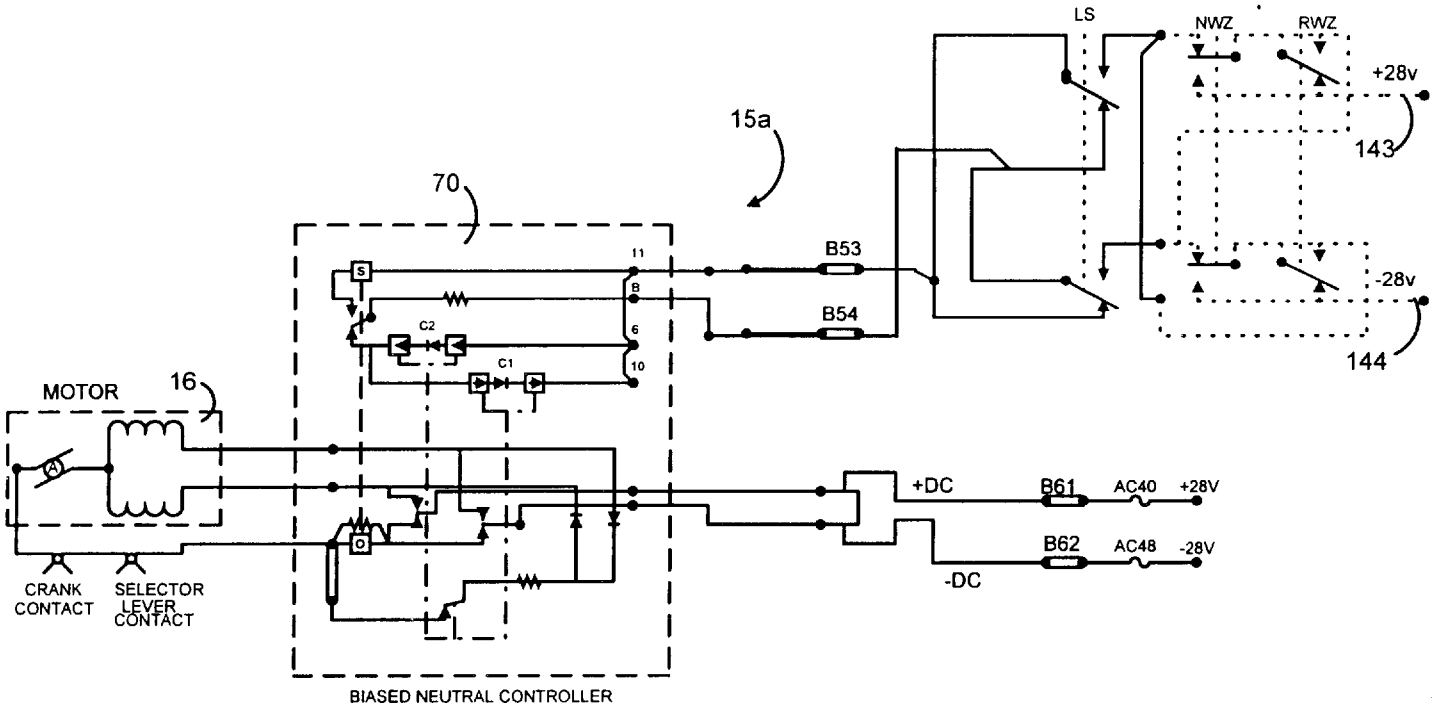
FIG. 11*b* is an electrical schematic of the switch machine, as altered to incorporate the inventive switch point position detection system.
Figure 11C:
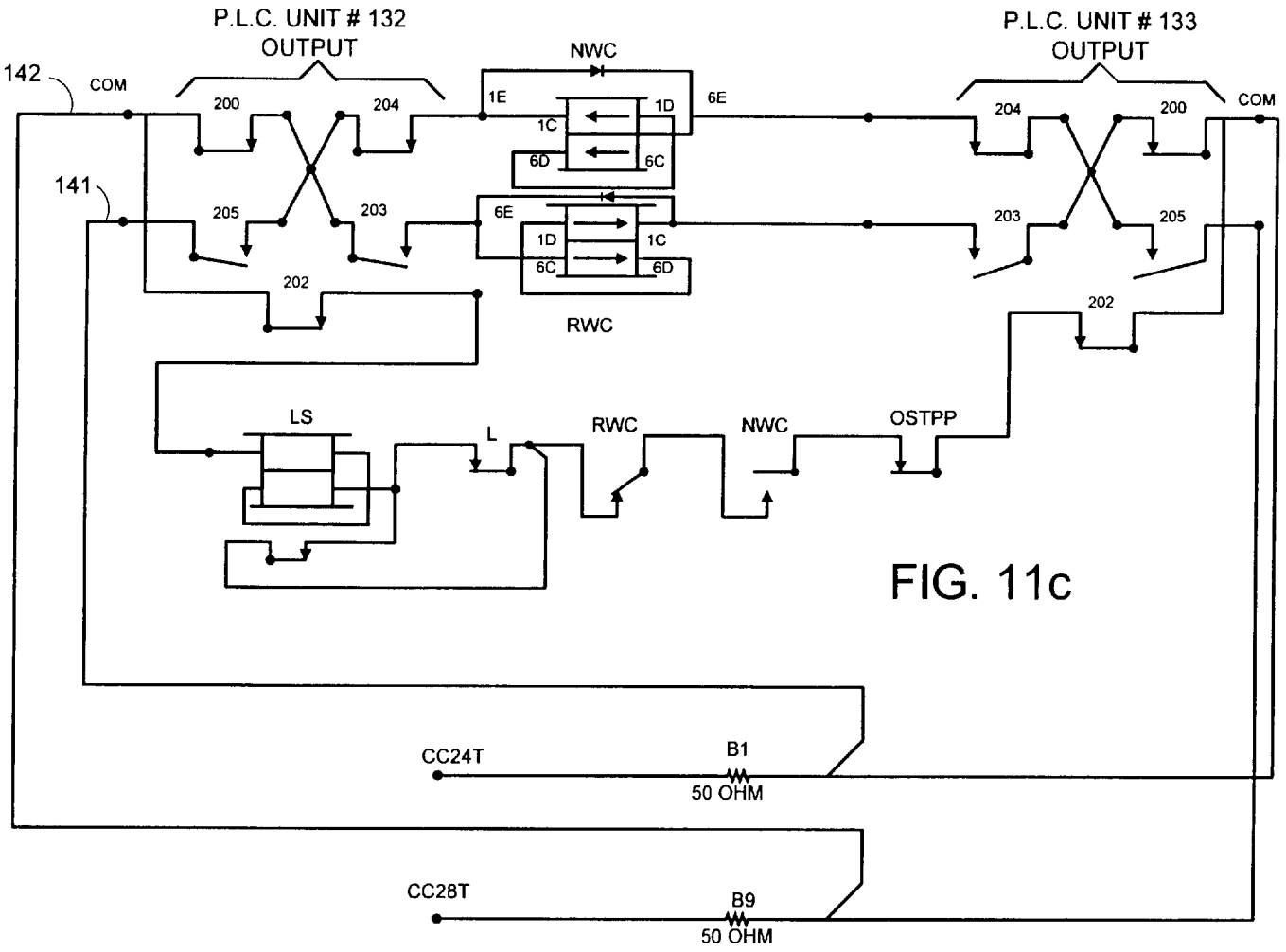
FIG. 11*c* is an electrical schematic of the PLC outputs to relays which remotely signal the switch point position status and control the switch machine.

Referring to FIG. 11*c*, each PLC 132 and 133 has a number of switched outputs, five of which, numbered 200, 202, 203, 204 and 205 are shown selectively linking a positive voltage bus 141 and a common bus 142 to the relays NWC, RWC and a lock stick (LS) relay. The PLC's 132 and 133 are connected in a totally redundant fashion such that a failure of either one will prevent operation of either the NWC or the RWC relays. This, in turn, prevents operation of external normal and reverse signals, such as those shown on the indicator board 135 and equivalent track side and remote signals (not shown). In each PLC 132 and 133, the contact 200 is a system check which is closed during normal operations and the contact 205 is a system check which is closed during reverse operations. The intersecting jumpers which interconnect the contacts 204, 200, 203 and 205 in each PLC 132 and 133 insures that, should the PLC be damaged from a power surge or the like, such that both system check contacts 200 and 205 are closed, then the circuit is shorted out via the common jumpers, with the 50 Ohm resistors B1 and B9 providing sufficient resistance to prevent the destruction of the PLC 132 or 133.

FIG. 11*b* illustrates wiring of the switch machine 15*a*, with the motor 16 connected to the biased neutral controller 70, which has been rewired as shown to selectively receive positive and negative 28 volt power from a pair of power buses 143 and 144 via contacts NWZ, RWZ and LS of the relays NWC, RWC, and LS, respectively, of FIG. 11*b*. The motor 16 is thus selectively driven to change the switch 1*a* between normal and reverse positions under control of the PLC's 132 and 133.

A ladder program is included herewith and labeled as appendix A. The program in appendix A, once input into the PLC's 132 and 133, insures that the proper sequence of inputs are received prior to energizing the LS, NWC or RWC relays. More specifically, in order to energize the NWC relay, the following conditions must be received at the inputs 1–7:

#1 Input ON Normal proximity detector 101 ON

#2 Input ON Lock Bar proximity detector 123 ON

#3 Input OFF Reverse proximity detector 102 OFF

#4 Input ON Normal switch request relay UP

#5 Input OFF Reverse switch request relay DOWN

#6 Input ON Normal lock rod proximity detector 121 ON

#7 Input OFF Reverse lock rod proximity detector 122 OFF

By contrast, in order to energize the RWC relay, both PLC's 131 and 132 must have the following inputs:

#1 Input OFF Normal proximity detector 101 OFF

#2 Input ON Lock Bar proximity detector 123 ON

#3 Input ON Reverse proximity detector 102 ON

#4 Input OFF Normal switch request relay DOWN

#5 Input ON Reverse switch request relay UP

#6 Input OFF Normal lock rod proximity detector 121 OFF

#7 Input ON Reverse lock rod proximity detector 122 ON

With the inventive switch point position sensing system and method, a reliable, redundant, solid state system is provided for sensing and remotely displaying the normal or reverse condition of the switch 1*a*. Furthermore, the positioning of proximity sensors 101 and 102 at the normal and reverse switch points gives a positive indication of both switch position and condition since a switch point which is bent or "laid over" will not approach the corresponding stock rail 6 or 7 close enough to energize the respective proximity detector 101 or 102.

Attached hereto as Appendix A is a logical ladder diagram for programming a pair of IDEC or Square D Micro-1 PLC's to control a typical railroad switch driven by a General Railway Signal switch machine.

Although the description and accompanying drawings are directed specifically to a General Railway Signal switch machine, conversion of railroad switch machines, including those of Union Switch and Signal and others can be adapted to the inventive switch point position sensing system and method in a similar fashion. In the case of the Wabco switches manufactured by Union Switch and Signal, only two internal proximity detectors are used instead of the three described herein. For simpler, manually operated switches such as are found in switching yards, for example, where visual checks are easier to implement, and where no positive lock is provided, the only safety check needed typically is for the normal switch point position. Typically in these hand thrown switches, a switch circuit controller positioned in a box alongside the switch checks normal position via some type of position sensing rod. It is contemplated that a pair of proximity detectors can be positioned on the normal switch point with each detector being connected to a separate PLC. The PLC's can be interlocked logically so that a cross check is performed to determine that both proximity detectors are reading the same prior to operating a safe to proceed normal signal. In addition to General Railway Signal and Union Switch and Signal, Western Cullen Hayes Company of Illinois makes hand thrown switches which can be so modified. Although these hand thrown switches may not typically called "switch machines", that term as it is used herein is intended to encompass both electric switch machines and purely hand thrown switches as well.

Also, while the proximity detectors 101 and 102 have been shown as attached to the switch point, it is contemplated that they could be attached to the stock rails 6 or 7 to sense the switch point 2 or 3 when they are in proximity to the rail 6 or 7 and the claims have been drafted to cover this variation. Furthermore, PLC's other than the IDEC Micro-1 model and proximity detectors other than model XS1 M30DA210L1TF manufactured by Telemecanique can be used as well. For example, Keyence PLC's manufactured by the Keyence Corp. of Japan, as well as various other PLC's could be used instead.

Therefore, it should be understood that while certain forms of the present invention have been illustrated and described herein, it is not to be limited to the specific forms or arrangement of parts described and shown.

APPENDIX A

C:\CLIP\GRS-M2 Ladder Listing

```
 1 +--| |-------------------------------------------------------------(SET)+
    |  704                                                              402 |
 2 +--|/|-----|/|-----|/|-----|/|-----|/|-----|/|---------------------(RST)+
    |  704     1     2     3     6     7                                402 |
 3 +--|/|---[T   6]-------------------------------------------------(    )+
    |    6    20                                                       426 |
 4 +--| |-----| |-----|/|-----|/|--+--|/|-------------------------(    )+
    |    4     6     1     2  |  426                                  400 |
 5 +--| |-----| |-----------------+
    |    6   400                 |
 6 +--|/|-----| |-----------------+
    |    0   400
 7 +--|/|---[T   1]-------------------------------------------------(    )+
    |    1    20                                                       421 |
 8 +--| |-----| |-----|/|--+--|/|-----------------------------------(    )+
    |    1   400     2  |  421                                        204 |
 9 +--|/|-----| |----------+
    |    0   204          |
10 +--| |-----| |----------+
    |    1   204
11 +--|/|---[T   7]-------------------------------------------------(    )+
    |    7    20                                                       427 |
12 +--| |-----| |-----|/|-----|/|--+--|/|-------------------------(    )+
    |    5     7     3     2  |  427                                  401 |
13 +--| |-----| |-----------------+
    |    7   401                 |
14 +--|/|-----| |-----------------+
    |    0   401
15 +--|/|---[T   3]-------------------------------------------------(    )+
    |    3    20                                                       423 |
16 +--| |-----| |-----|/|--+--|/|-----------------------------------(    )+
    |    3   401     2  |  423                                        203 |
17 +--|/|-----| |----------+
    |    0   203          |
18 +--| |-----| |----------+
    |    3   203
```

C:\CLIP\GRS-M2 Ladder Listing

```
19 +--|/|---[T   2]-----------------------------------------------(     )+
   |     2      20                                                422 |
   |
20 +--| |-----| |-----| |-----| |--+--| |-----|/|--+--|/|------------(     )+
   |     0       4     204     400 |     2     424 |   422            201 |
   |                               |                |                    |
21 +--| |-----| |-----| |-----| |--+                |                    |
   |     0       5     203     401                  |                    |
   |                                                |                    |
22 +--|/|-----| |--------------------------------+                       |
   |     0     201                                |                    |
   |                                              |                    |
23 +--| |-----| |--------------------------------+                       |
   |     2     201                                                     |
   |
24 +--| |-----| |-----|/|-----|/|---[T  15]-------------------------(     )+
   |     6       7     200     205       2                           430 |
   |
25 +--| |-----------------------------------------------------------(SET)+
   |   430                                                           405 |
   |
26 +--| |-----|/|-----|/|-----|/|---[T  25]-------------------------(     )+
   |     0       6     201       7       2                           431 |
   |
27 +--| |-----------------------------------------------------------(RST)+
   |   431                                                           405 |
   |
28 +--| |-----| |--+--|/|-----|/|---[T  16]-------------------------(     )+
   |     1       3 |   200     205       2                           432 |
   |               |
29 +--| |----------+
   |   420
   |
30 +--| |--+--------------------------------------------------------(SET)+
   |   405 |                                                         406 |
   |       |
31 +--| |--+
   |   432
   |
32 +--| |-----|/|-----|/|-----|/|-----|/|---[T  26]----------------(     )+
   |     0       1     201       3     405       2                   403 |
   |
33 +--| |-----------------------------------------------------------(RST)+
   |   403                                                           406 |
   |
34 +--|/|-----| |-----|/|---[T  17]-----------------------------(     )+
   |   204     201     203       2                                 404 |
   |
35 +--| |-----------------------------------------------------------(SET)+
   |   404                                                           407 |
   |
36 +--| |-----|/|-----|/|-----|/|---[T  27]-------------------------(     )+
   |     0       6     201       7       2                           425 |
   |
```

C:\CLIP\GRS-M2 Ladder Listing

```
37 +--| |-------------------------------------------------------------(RST)+
   |   425                                                              407 |
   |
38 +--| |-----| |-----| |-----| |-----|/|-----|/|-----|/|-----|/|--------> |
   |   201     204     400       4       5     402     405     406        |
   |
39 |>---------|/|-------------------------------------------------------(     )+
   |           407                                                      200 |
   |
40 +--| |-----| |-----| |-----|/|-----| |-----|/|-----|/|-----|/|--------> |
   |   201     203     401       4       5     402     405     406        |
   |
41 |>---------|/|-------------------------------------------------------(     )+
   |           407                                                      205 |
   |
42 +--| |--+--|/|-----|/|--+--| |-----------------------------------(     )+
   |     4 |     3       7 |   406                                    410 |
   |       |                |
43 |       +--| |----------+
   |           411          |
   |                        |
44 +--| |------------------+
   |   410
   |
45 +--| |--+--|/|-----|/|--+--| |-----------------------------------(     )+
   |     5 |     1       6 |   406                                    411 |
   |       |                |
46 |       +--| |----------+
   |           410          |
   |                        |
47 +--| |------------------+
   |   411
   |
48 +--| |--+--| |-----------------------------------------------------(     )+
   |     4 |   407                                                    412 |
   |       |
49 +--| |--+
   |   412
   |
50 +--| |--+--| |-----------------------------------------------------(     )+
   |     5 |   407                                                    413 |
   |       |
51 +--| |--+
   |   413
   |
52 +--| |-----| |--+--------------------------------------------------(     )+
   |   410     411 |                                                  414 |
   |               |
53 +--|/|----------+
   |   406
   |
54 +--| |-----| |--+--------------------------------------------------(     )+
   |   412     413 |                                                  415 |
   |               |
```

C:\CLIP\GRS-M2 Ladder Listing

```
55 +--|/|----------+                                                                  |
   |   407                                                                            |
   |                                                                                  |
56 +--| |-----| |-----| |-----------------------------------------(     )+
   |     0     414     415                                                  202 |
   |                                                                                  |
57 +--| |-----|/|-----|/|--+[T  20]-----------------------------------(     )+
   |     2       1       3 |     2                                            420 |
   |                       |                                                        |
58 +--| |-----|/|-----|/|--+                                                        |
   |     2       6       7                                                            |
   |                                                                                  |
59 +--| |-----| |-----------------------------------------------------(SET)+
   |   420       0                                                            424 |
   |                                                                                  |
60 +--|/|-----|/|-----|/|-----------------------------------------------(RST)+
   |     2       1       3                                                    424 |
   |                                                                                  |
61 +-----------------------------------------------------------------------(END)+
   |                                                                                  |
```

What is claimed and desired to be secured by Letters Patent is as follows:

1. A switch point position sensing system for a railroad switch, the switch including a normal and a reverse switch point positioned between normal and reverse stationary stock rails with the switch points being linked together and being movable between a normal position and a reverse position by a switch machine, said switch including a remote indicator of switch condition including normal and/or reverse switch condition indicators, said switch point position detection system comprising:

a. a first point proximity detector attached to a respective one of said switch points or a corresponding one of said stock rails, said first point proximity detector giving a positive proximity indication when the respective switch point is moved to a position proximate the corresponding stock rail and giving a negative proximity indication when the respective switch point is moved away from the corresponding stock rail as said switch is changed between said normal and reverse switch positions; and b. a programmable controller connected to and programmed to be responsive to said first point proximity detector to control said remote indicator to give an indication of normal switch position when the switch is in the normal position and/or a reverse indication of reverse switch position when the switch is in the reverse position.

2. A switch point position sensing system as in claim 1, wherein said first point proximity detector is a normal switch point proximity detector with the respective switch point being the normal switch point and the corresponding stock rail being the normal stock rail, said system further comprising:

a. a second point proximity detector attached to either the reverse switch point or the reverse stock rail, said second point proximity detector giving a positive proximity indication when the reverse switch point is moved to a position proximate the reverse stock rail and giving a negative proximity indication when the reverse switch point is moved away from the reverse stock rail as said switch is changed between said normal and reverse switch positions; and b. said programmable controller is also connected to and programmed to be responsive to said second point proximity detector to control said remote indicator.

3. A switch point position sensing system for a railroad switch, the switch including a normal and a reverse switch point positioned between normal and reverse stationary stock rails with the switch points being linked together and being movable between a normal position and a reverse position by a switch machine, said switch including a remote indicator of switch condition including normal and/or reverse switch condition indicators, said switch machine including a lock rod which is movable with the normal and reverse switch points between a normal lock position and a reverse lock position, said switch point position detection system comprising:

a. a first point proximity detector attached to a respective one of said switch points or a corresponding one of said stock rails, said first point proximity detector giving a positive proximity indication when the respective switch point is moved to a position proximate the corresponding stock rail and giving a negative proximity indication when the respective switch point is moved away from the corresponding stock rail as said switch is changed between said normal and reverse switch positions; and b. a programmable controller connected to and programmed to be responsive to said first point proximity detector to control said remote indicator to give an indication of normal switch position when the switch is in the normal position and/or a reverse indication of reverse switch position when the switch is in the reverse position;

c. a first lock rod proximity sensor positioned to detect said lock rod in one of said normal lock position or said reverse lock position; and d. said programmable controller is also connected to and programmed to be responsive to said first lock rod proximity detector to control said remote indicator.

4. A switch point position sensing system as in claim 3, said first lock rod proximity detector giving a positive proximity indication when the lock rod is in the normal lock position, said system further comprising:

a. a second lock rod proximity detector positioned to detect said lock rod in the reverse lock position; and b. said programmable controller is also connected to and programmed to be responsive to said second lock rod proximity detector to control said remote indicator.

5. A switch point position sensing system as in claim 4, said remote indicator including a normal switch correspondence relay and a reverse switch correspondence relay which, respectively, control the normal and reverse switch condition indicators, wherein:

a. said programmable controller includes pair of programmable logic circuits (PLC's), each said PLC including a plurality of control inputs connected in parallel and a plurality of programmable output switches; and b. said reverse switch correspondence relay and said normal switch correspondence relay each includes a relay coil connected between output switches of the pair of PLC's, said PLC's being programmed such that only one of said relay coils can be operated at a given time.

6. A switch point position sensing system as in claim 5, said switch further comprising a normal switch request relay and a reverse switch request relay, each of which includes a corresponding relay switch contact which signals a request for respective normal or reverse switch positions, wherein:

a. each of said PLC's has a pair of control inputs with each input of the pair connected to a respective one of said normal or reverse switch request relay contacts.

7. A switch point position sensing system as in claim 5, wherein:

a. each of said PLC's has a separate control input connected to each of said rail proximity detectors and said lock proximity detectors.

8. A switch point position sensing system as in claim 5, wherein:

a. each of said PLC's is programmed to detect a predetermined number and order of relay switch request contacts and proximity detector proximity indications prior to enabling either the normal switch correspondence relay or the reverse switch correspondence relay.

9. A switch point position sensing system as in claim 3, wherein said switch machine further includes a lock bar engaging the lock rod to lock the switch in either the normal or reverse lock position, said lock bar being movable between a lock position and an unlock position, said system further comprising:

a. a lock bar proximity sensor positioned to detect said lock bar in one of said lock or said unlock positions; and b. said programmable controller is also connected to and programmed to be responsive to said lock bar proximity detector to control said remote indicator.

10. A switch point position sensing system for a railroad switch, the switch including a normal and a reverse switch point positioned between normal and reverse stationary stock rails with the switch points being linked together and being movable between a normal position and a reverse position by a switch machine, wherein said switch machine includes a lock rod which is movable with the normal and reverse switch points between a normal lock position and a reverse lock position, said switch including a remote indicator of switch condition including normal and reverse switch condition indicators, said switch point position detection system comprising:

a. a normal point proximity detector attached to said normal switch point or said normal stock rail, said normal point proximity detector giving a positive proximity indication when the respective switch point is moved to a position proximate the normal stock rail and giving a negative proximity indication when the normal switch point is moved away from the normal stock rail as said switch is changed between said normal and reverse switch positions;

b. a reverse point proximity detector attached to either the reverse switch point or the reverse stock rail, said reverse point proximity detector giving a positive proximity indication when the reverse switch point is moved to a position proximate the reverse stock rail and giving a negative proximity indication when the reverse switch point is moved away from the reverse stock rail as said switch is changed between said normal and reverse switch positions;

c. a normal lock rod proximity sensor positioned to detect said lock rod in said normal lock position;

d. a reverse lock rod proximity sensor positioned to detect said lock rod in said reverse lock position; and e. a programmable controller connected to and programmed to be responsive to said normal and reverse point proximity detectors and to said normal and reverse lock rod detectors to control said remote indicator.

11. A switch point position sensing system as in claim 10, said remote indicator including a normal switch correspondence relay and a reverse switch correspondence relay which, respectively, control the normal and reverse switch condition indicators, wherein: a. said programmable controller includes pair of programmable logic circuits (PLC's), each said PLC including a plurality of control inputs connected in parallel and a plurality of programmable output switches; and b. said reverse switch correspondence relay and said normal switch correspondence relay each includes a relay coil connected between output switches of the pair of PLC's, said PLC's being programmed such that only one of said relay coils can be operated at a given time.

12. A switch point position sensing system as in claim 10, said switch further comprising a normal switch request relay and a reverse switch request relay, each of which includes a corresponding relay switch contact which signals a request for respective normal or reverse switch positions, wherein:

a. each of said PLC's has a pair of control inputs with each input of the pair connected to a respective one of said normal or reverse switch request relay contacts.

13. A switch point position sensing system as in claim 12, wherein:

a. each of said PLC's has a separate control input connected to each of said rail proximity detectors and said lock proximity detectors.

14. A switch point position sensing system as in claim 13, wherein:

a. each of said PLC's is programmed to detect a predetermined number and order of relay switch request contacts and proximity detector proximity indications prior to enabling either the normal switch correspondence relay or the reverse switch correspondence relay.

15. A switch point position sensing system as in claim 11, wherein said switch machine further includes a lock bar engaging the lock rod to lock the switch in either the normal or reverse lock position, said lock bar being movable between a lock position and an unlock position, said system further comprising:

a. a lock bar proximity sensor positioned to detect said lock bar in one of said lock or said unlock positions; and b. said programmable controller is also connected to and programmed to be responsive to said lock bar proximity detector to control said remote indicator.

16. A method of monitoring switch point position for a railroad switch, the switch including a normal and a reverse switch point positioned between normal and reverse stationary stock rails with the switch points being linked together and being movable between a normal position and a reverse position by a switch machine, said switch including a remote indicator of switch condition including normal and reverse switch condition indicators, said method comprising the steps of:

a. attaching a first point proximity detector to a respective one of said switch points or a corresponding stock rail, said first point proximity detector giving a positive proximity indication when the respective switch point is moved to a position proximate the corresponding stock rail and giving a negative proximity indication when the respective switch point is moved away from the corresponding stock rail as said switch is changed between said normal and reverse switch positions; and b. connecting a first PLC to and programming the first PLC to be responsive to said first point proximity detector to control said remote indicator to give an indication of normal switch position when the switch is in the normal position and a reverse indication of reverse switch position when the switch is in the reverse position.

17. A method as in claim 16, wherein said first point proximity detector is a normal switch point proximity detector with the respective switch point being the normal switch point and the corresponding stock rail being the normal stock rail, said method further comprising the steps of:

a. attaching a second point proximity detector to either the reverse switch point or the reverse stock rail, said second point proximity detector giving a positive proximity indication when the reverse switch point is moved to a position proximate the reverse stock rail and giving a negative proximity indication when the reverse switch point is moved away from the reverse stock rail as said switch is changed between said normal and reverse switch positions; and b. connecting said first PLC and programming it to be responsive to said second point proximity detector to control said remote indicator.

18. A method of monitoring switch point position for a railroad switch, the switch including a normal and a reverse switch point positioned between normal and reverse stationary stock rails with the switch points being linked together and being movable between a normal position and a reverse position by a switch machine, said switch including a remote indicator of switch condition including normal and reverse switch condition indicators, said switch including a lock rod which is movable with the normal and reverse switch points between a normal lock position and a reverse lock position, said method comprising the steps of:

a. attaching a first point proximity detector to a respective one of said switch points or a corresponding one of said stock rails, said first point proximity detector giving a positive proximity indication when the respective switch point is moved to a position proximate the corresponding stock rail and giving a negative proximity indication when the respective switch point is moved away from the corresponding stock rail as said switch is changed between said normal and reverse switch positions; and b. connecting a first PLC to and programming the first PLC to be responsive to said first point proximity detector to control said remote indicator;

c. positioning a first lock rod proximity sensor to detect said lock rod in one of said normal lock position or said reverse lock position; and d. connecting said first PLC to and programming it to be responsive to said first lock rod proximity detector to control said remote indicator.

19. A method as in claim 18, said first lock rod proximity detector giving a positive proximity indication when the lock rod is in the normal lock position, said system further comprising:

a. positioning a second lock rod proximity detector to detect said lock rod in the reverse lock position; and b. connecting said first PLC to and programming it to be responsive to said second lock rod proximity detector to control said remote indicator.

20. A method as in claim 19, and further comprising the step of: a. connecting a separate control input on each of said PLC's to each of said rail proximity detectors and said lock proximity detectors.

21. A method as in claim 20, said switch further comprising a normal switch request relay and a reverse switch request relay, each of which includes a corresponding relay switch contact which signals a request for respective normal or reverse switch positions, said method further comprising the steps of:

a. connecting a pair of control inputs for each of said PLC's such that each input of the pair is connected to a respective one of said normal or reverse switch request relay contacts.

22. A method as in claim 20, and further comprising the step of:

a. connecting a separate control input on each of said PLC's to each of said rail proximity detectors and said lock proximity detectors.

23. A method as in claim 22, and further comprising the steps of:

a. programming each of said PLC's to detect a predetermined number and order of relay switch request contacts and proximity detector proximity indications prior to enabling either the normal switch correspondence relay or the reverse switch correspondence relay.

24. A method as in claim 18, wherein said switch machine further includes a lock bar engaging the lock rod to lock the switch in either the normal or reverse lock position, said lock bar being movable between a lock position and an unlock position, said method further comprising the steps of:

a. positioning a lock bar proximity sensor to detect said lock bar in one of said lock or said unlock positions; and b. connecting said PLC to and programming it to be responsive to said lock bar proximity detector to control said remote indicator.

25. A method of converting a railroad switch machine from a electromechanical sensing of switch point position to solid state sensing of switch point position, the switch machine controlling a switch with a normal and a reverse switch point positioned between normal and reverse stationary stock rails with the switch points being linked together and being movable between a normal position and a reverse position by a switch machine, said switch including a remote indicator of switch condition including normal and reverse switch condition indicators, said switch machine including a point detector rod connected to at least one of said switch points so as to move between a normal and a reverse point detection position as the switch points are moved between the normal and reverse switch position, respectively, and a plurality of point detector contacts controlled by the movement of the point detector rod, said method comprising the steps of:

a. removing said point detector rod and said plurality of point detector contacts;

b. attaching a first point proximity detector to a respective one of said switch points or a corresponding one of said stock rails, said first point proximity detector giving a positive proximity indication when the respective switch point is moved to a position proximate the corresponding stock rail and giving a negative proximity indication when the respective switch point is moved away from the corresponding stock rail as said switch is changed between said normal and reverse switch positions; and c. connecting a first PLC to and programming the first PLC to be responsive to said first point proximity detector to control said remote indicator.

26. A method as in claim 25, wherein said first point proximity detector is a normal switch point proximity detector with the respective switch point being the normal switch point and the corresponding stock rail being the normal stock rail, said method further comprising the steps of:

a. attaching a second point proximity detector to either the reverse switch point or the reverse stock rail, said second point proximity detector giving a positive proximity indication when the reverse switch point is moved to a position proximate the reverse stock rail and giving a negative proximity indication when the reverse switch point is moved away from the reverse stock rail as said switch is changed between said normal and reverse switch positions; and b. connecting said first PLC and programming it to be responsive to said second point proximity detector to control said remote indicator.

27. A method as in claim 25, wherein said switch machine includes a lock rod which is movable with the normal and reverse switch points between a normal lock position and a reverse lock position, said method further comprising the steps of:

a. positioning a first lock rod proximity sensor to detect said lock rod in one of said normal lock position or said reverse lock position; and b. connecting said first PLC to and programming it to be responsive to said first lock rod proximity detector to control said remote indicator.

28. A method as in claim 27, said first lock rod proximity detector giving a positive proximity indication when the lock rod is in the normal lock position, said system further comprising:

a. positioning a second lock rod proximity detector to detect said lock rod in the reverse lock position; and b. connecting said first PLC to and programming it to be responsive to said second lock rod proximity detector to control said remote indicator.

29. A method as in claim 28, said remote indicator including a normal switch correspondence relay and a reverse switch correspondence relay, each with respective relay coils which, respectively, control the normal and reverse switch condition indicators, said method further comprising the steps of:

a. connecting a second PLC with control inputs in parallel with control inputs of the first PLC, each said PLC including a plurality of programmable output switches;

b. connecting said reverse switch correspondence relay and said normal switch correspondence relay coils between output switches of the pair of PLC's; and c. programming said PLC's such that only one of said relay coils can be operated at a given time.

30. A method as in claim 29, said switch further comprising a normal switch request relay and a reverse switch request relay, each of which includes a corresponding relay switch contact which signals a request for respective normal or reverse switch positions, said method further comprising the steps of:

a. connecting a pair of control inputs for each of said PLC's such that each input of the pair is connected to a respective one of said normal or reverse switch request relay contacts.

31. A method as in claim 29, and further comprising the step of:

a. connecting each of said PLC's such that a separate control input is connected to each of said rail proximity detectors and said lock proximity detectors.

32. A method as in claim 31, and further comprising the steps of:

a. programming each of said PLC's to detect a predetermined number and order of relay switch request contacts and proximity detector proximity indications prior to enabling either the normal switch correspondence relay or the reverse switch correspondence relay.

33. A method as in claim 27, wherein said switch machine also includes a lock bar engaging the lock rod to lock the switch in either the normal or reverse lock position, said lock bar being movable between a lock position and an unlock position, said method further comprising the steps of:

a. positioning a lock bar proximity sensor to detect said lock bar in one of said lock or said unlock positions; and b. connecting said PLC to and programming it to be responsive to said lock bar proximity detector to control said remote indicator.

* * * * *